United States Patent [19]

Takashi

[11] Patent Number: 4,888,811

[45] Date of Patent: Dec. 19, 1989

[54] LOUDSPEAKER DEVICE

[75] Inventor: Makino Takashi, Hamamatsu, Japan

[73] Assignee: Yamaha Corporation, Hamamatsu, Japan

[21] Appl. No.: 82,644

[22] Filed: Aug. 6, 1987

[30] Foreign Application Priority Data

Aug. 8, 1986 [JP] Japan ..... 61-186198

[51] Int. Cl.[4] ..... H04R 3/04; H04R 5/02

[52] U.S. Cl. ..... 381/111; 381/98; 381/99; 381/101

[58] Field of Search ..... 381/97, 98, 99, 100, 381/101, 102, 103, 111, 117; 375/12-15; 455/305, 618; 84/1.19, 1.23, DIG. 9; 333/28 T, 132

[56] References Cited

U.S. PATENT DOCUMENTS

| | | | |
|---|---|---|---|
| 4,421,949 | 12/1983 | Eberbach | 381/98 |
| 4,423,289 | 12/1983 | Swinbanks | 381/99 |
| 4,429,181 | 1/1984 | Freadman | 381/99 |
| 4,458,362 | 7/1984 | Berkovitz et al. | 381/101 |

FOREIGN PATENT DOCUMENTS

| | | | |
|---|---|---|---|
| 52-33517 | 3/1977 | Japan | 381/99 |

*Primary Examiner*—Donald J. Yusko
*Assistant Examiner*—Tyrone Queen
*Attorney, Agent, or Firm*—Spensley, Horn, Jubas & Lubitz

[57] ABSTRACT

A loudspeaker device comprises an input circuit for obtaining an input signal to be sounded by a loudspeaker as a digital signal, a phase correction circuit for correcting the digital signal in phase, a loudspeaker drive circuit for producing a loudspeaker drive signal in accordance with the digital signal which has been phase-corrected by the phase correction circuit, and loudspeakers driven by the loudspeaker drive signal. The phase correction circuit consists of a digital filter capable of determining sound pressure-frequency characteristics and frequency-phase characteristics independently from each other. By determining the two characteristics in such a manner that, for example, the sound pressure-frequency characteristics will become flat and the phase-frequency characteristics will become linear, naturalness in hearing can be improved.

7 Claims, 13 Drawing Sheets

LOUDSPEAKER DEVICE

BACKGROUND OF THE INVENTION

This invention relates to a loudspeaker device and, more particularly, to a loudspeaker device capable of establishing phase-frequency characteristics independently from sound pressure (response)-frequency characteristics thereby to realize linear phase-frequency characteristics and flat sound pressure-frequency characteristics (i.e., completely realizing a transfer function which is 1).

Taking a three way speaker system for typical example, the system is composed of a woofer unit, a squawker unit, a tweeter unit, a network for dividing a signal into high, middle and low frequency bands and an enclosure for housing these component parts.

The multi-way speaker system is designed to achieve expansion of frequency range which can be sounded and a lower distortion factor. If, however, the sound pressure-frequency characteristics are flattened, the phase-frequency characteristics do not become linear as shown in FIG. 2 (a delay in the phase occurs generally in the low frequency range as compared with the high frequency range) thereby causing unnaturalness in hearing. The unnaturalness in hearing is caused by nonlinearity of the phase-frequency characteristics because a musical tone signal is composed of a fundamental wave and various harmonic components and, if each frequency range in which these harmonics are distributed is of a greatly different phase from that of the original tone, a waveform of a tone sounded from the loudspeaker becomes greatly different from that of the original tone, even though the sound pressure-frequency characteristics are flat.

The phase difference between frequency ranges described above is caused by an analog crossover network composed of a capacitor (C), a coil (L) and a resistor (R). More specifically, if the crossover network in the prior art device is constructed in such a manner that the sound pressure-frequency characteristics become flat, the phase-frequency characteristics also are changed with a result that the two characteristics cannot be made optimum simultaneously. In a case where other means for adjusting the sound pressure-frequency characteristics, e.g., a graphic equalizer, is employed, the problem that the phase-frequency characteristics are changed likewise takes place.

For realizing linearity in the phase-frequency characteristics of a loudspeaker, there are devices such as a device in which, as shown in FIG. 3, loudspeaker units (tweeter 10, squawker 12 and woofer 14) are arranged stepwise and a device employing an analog filter, i.e., an analog delay circuit for correcting phase in addition to a network for dividing a signal into several frequency bands.

In the device in which the loudspeaker units 10, 12 and 14 are arranged stepwise as shown in FIG. 3, however, projections and recesses are formed in an enclosure 16 with a result that the tone wave is seriously affected by diffraction thereby making realization of flattened phase-frequency characteristics difficult. Besides, since the correction of phase by this device is not an electrical phase correction, adjustment of the phase-frequency characteristics itself is also difficult.

In the prior art device employing the analog filter, there is the disadvantage that tone quality is deteriorated due to distortion caused in analog elements themselves.

It is, therefore, an object of the invention to provide a loudspeaker device capable of correcting phase independently from the sound pressure-frequency characteristics and thereby capable of realizing flat sound pressure-frequency characteristics and linear phase-frequency characteristics simultaneously without requiring a special arrangement of loudspeaker units which causes diffraction in a sound wave or a correction filter which causes deterioration in the tone quality.

SUMMARY OF THE INVENTION

For achieving the above described object of the invention, the loudspeaker device according to the invention is characterized in that it comprises input means for obtaining an input signal to be sounded by a loudspeaker as a digital signal, phase correction means for receiving the digital signal obtained from the input means for phase correction, the phase correction means consisting of a digital filter capable of determining sound pressure-frequency characteristics and phase-frequency characteristics independently from each other, loudspeaker drive means for producing a loudspeaker drive signal in accordance with the digital signal which has been phase-corrected by the phase correction means, and loudspeaker means driven by the loudspeaker drive signal.

According to the invention, a digital signal obtained by the input means (when an input signal is a digital signal, it is obtained directly whereas when the input signal is an analog signal, it is obtained by analog-to-digital conversion) is corrected in phase by the digital filter and thereafter is used to drive the loudspeaker means through the loudspeaker drive means.

Since the digital filter can determine the phase-frequency characteristics independently from the sound pressure-frequency characteristics, naturalness in hearing can be improved by, for example, realizing flattened sound pressure-frequency characteristics and linear phase-frequency characteristics.

The phase-frequency characteristics in the digital filter can be adjusted readily and purely electrically by, for example, changing a tap coefficient of the digital filter.

According to the invention, no special arrangement of the loudspeaker units or analog correction filter as in the prior art devices is required so that the adverse effect by diffraction in the sound wave and deterioration in the tone quality as in the prior art devices can be eliminated.

Since the adjustment of amplitude and compensation of phase change accompanying such adjustment of amplitude in the digital filter is completely realized, a more complicated division of frequency into frequency bands than in the prior art can be realized.

In a case where an input signal is a digital signal (e.g., a digital signal from a Compact Disc in the Compact Disc Digital Audio System), the input signal can be directly processed in digital so that deterioration in the tone quality can be held at the minimum.

In a case where an input signal is an analog signal, the loudspeaker playback device may comprise an analog input terminal receiving an analog input signal, an analog-to-digital converter for converting the received analog input signal to a digital signal, phase correction means receiving the output digital signal from the analog-to-digital converter and consisting of a digital filter capable of determining phase-frequency characteristics independently from sound pressure-frequency characteristics, a digital-to-analog converter for converting the digital signal provided by the phase correction means to an analog signal, a power amplifying means for amplifying the output of the digital-to-analog converter in power, and loudspeaker means driven by the output of the power amplifying means, and the analog input terminal, analog-to-digital converter, phase correction means, digital-to-analog converter, power amplifying means and loudspeaker means may be incorporated integrally in a loudspeaker enclosure. According to this arrangement, the device according to the invention can be connected readily to conventional analog audio devices.

The loudspeaker device according to the invention can be constructed in such a manner that either one or both of the sound pressure-frequency characteristics and the phase-frequency characteristics of the phase correction means can be adjusted as desired in accordance with characteristics of loudspeakers used. Alternatively,, the loudspeaker device can be constructed in such a manner that the two characteristics are fixedly established in a case where loudspeakers used are always same.

The invention can be used for correcting phase characteristics of the crossover network of loudspeakers and, in addition thereto, can be used for various other purposes in which the sound pressure-frequency characteristics and the phase-frequency characteristics are determined independently from each other.

The phase correction means in this invention can be used as the crossover network as in the prior art devices or a channel divider in a multi-channel system.

For the digital filter used in the invention, a non recursive digital filter (FIR digital filter), a recursive digital filter (IIR digital filter) and digital filters of other types can be used.

Preferred embodiments of the invention will now be described with reference to the accompanying drawings.

BRIEF DESCRIPTION OF THE DRAWINGS

In the accompanying drawings.

DESCRIPTION OF PREFERRED EMBODIMENTS

[Embodiment 1]

(1) Outline

Figure 1:
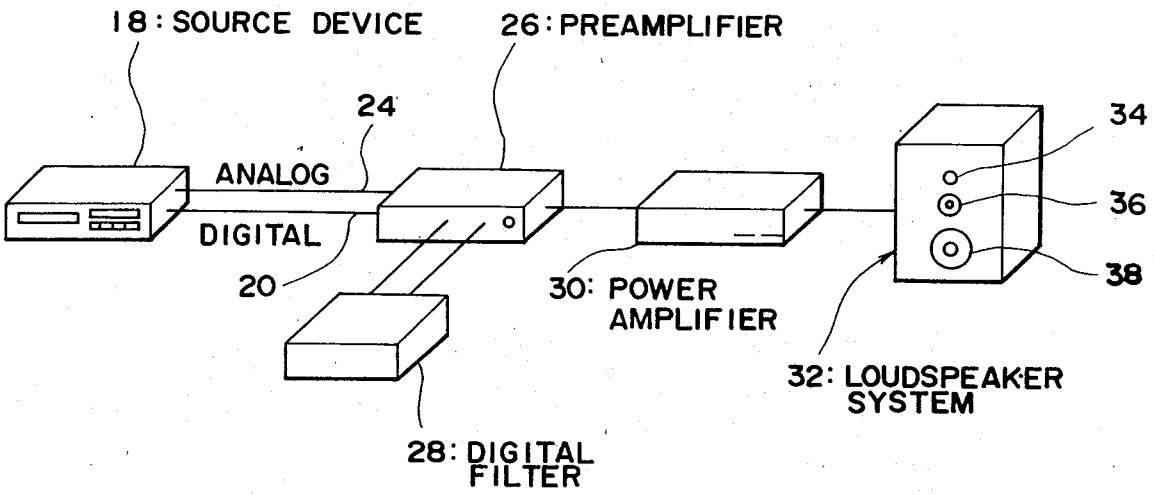
FIG. 1 is a schematic view of a first embodiment of the loudspeaker device according to the invention.
Figure 2:
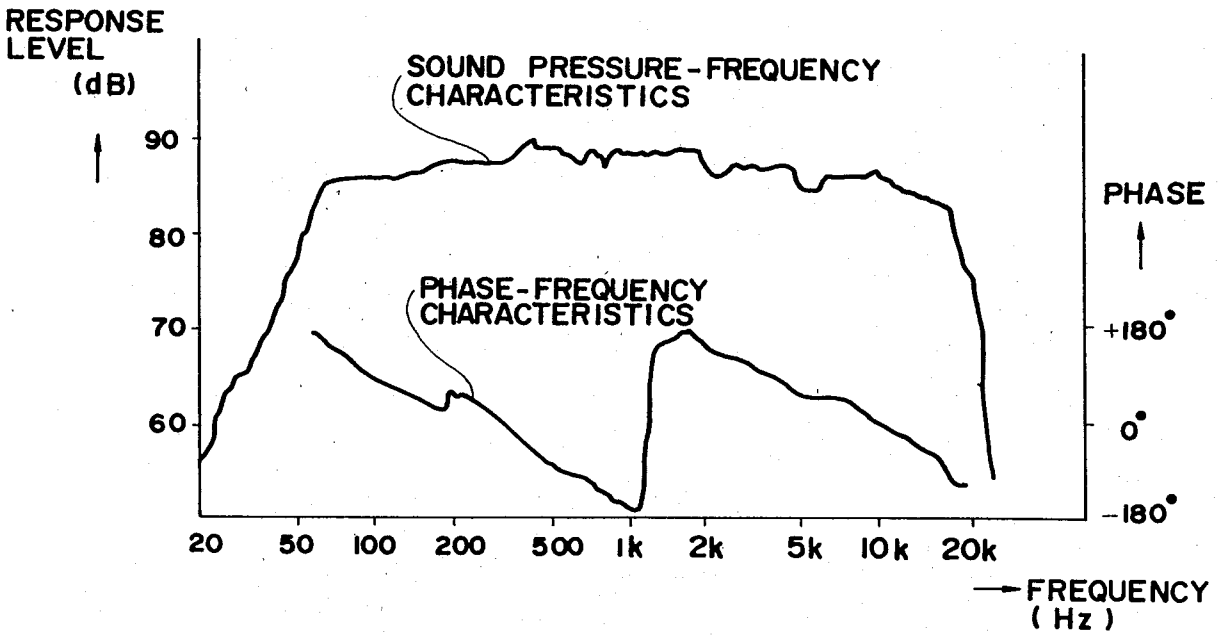
FIG. 2 PRIOR ART
FIG. 2 is a graph showing an example each of sound pressure-frequency characteristics and phase-frequency characteristics in a multi-way loudspeaker system.
Figure 3:
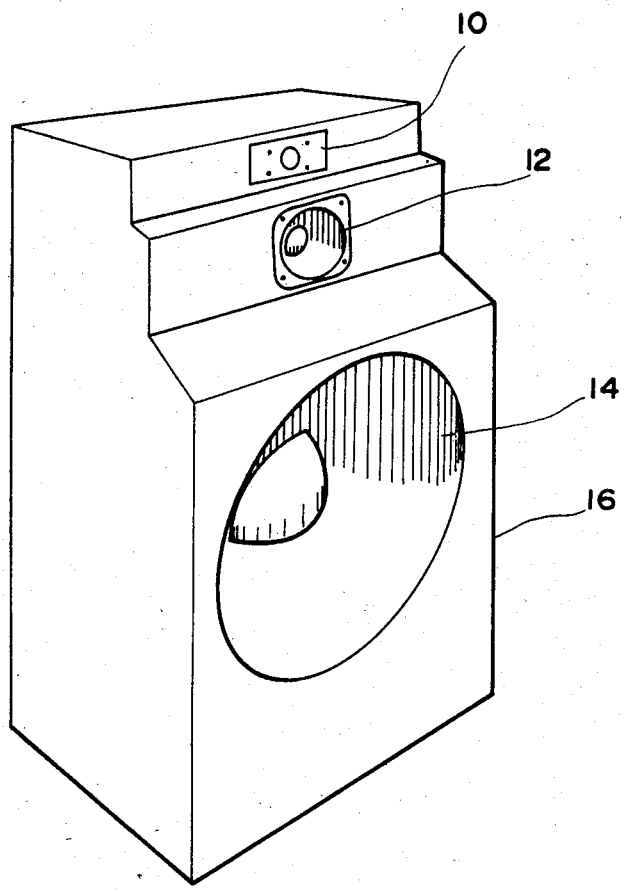
FIG. 3 PRIOR ART
FIG. 3 is a perspective view showing a prior art multi-way speaker system directed to flattening of the phase-frequency characteristics.

An embodiment of the invention is shown schematically in FIG. 1. This embodiment is constructed for driving a three-way speaker system incorporating an analog crossover network and comprises phase correction means consisting of a digital filter connected to a preamplifier.

In FIG. 1, a preamplifier 26 receives an audio output of a source device 18 such as a Compact Disc player, a video disc player with a digital sound or a record player. In a case where the source device 18 provides an audio output as a digital signal (e.g., a digital audio output of a Compact Disc player or a video disc player), the audio output is supplied to a digital input terminal of the preamplifier 26 through a digital output chord 20. In a case where the source device 18 provides an audio output as an analog signal (e.g., an analog audio output of a Compact Disc player, a video disc player or a record player), the audio output is supplied to an analog input terminal of the preamplifier 26 through an analog output chord 24.

When the input to the preamplifier 26 is a digital input signal, the preamplifier 26 supplies this input signal directly to a phase correcting digital filter 28 for correcting, for example, phase-frequency characteristics only without changing sound pressure-frequency characteristics. When the input is an analog input signal, the input signal is first converted to a digital signal and then is supplied to the phase correcting digital filter 28 for correction of the phase-frequency characteristics.

The phase corrected signal is converted to an analog signal in the preamplifier 26 and its analog output is supplied to three loudspeakers (tweeter 34, squawker 36 and woofer 38) of a loudspeaker system 32 through a power amplifier 30.

(2) In the case where an analog signal source device is used

Figure 4:
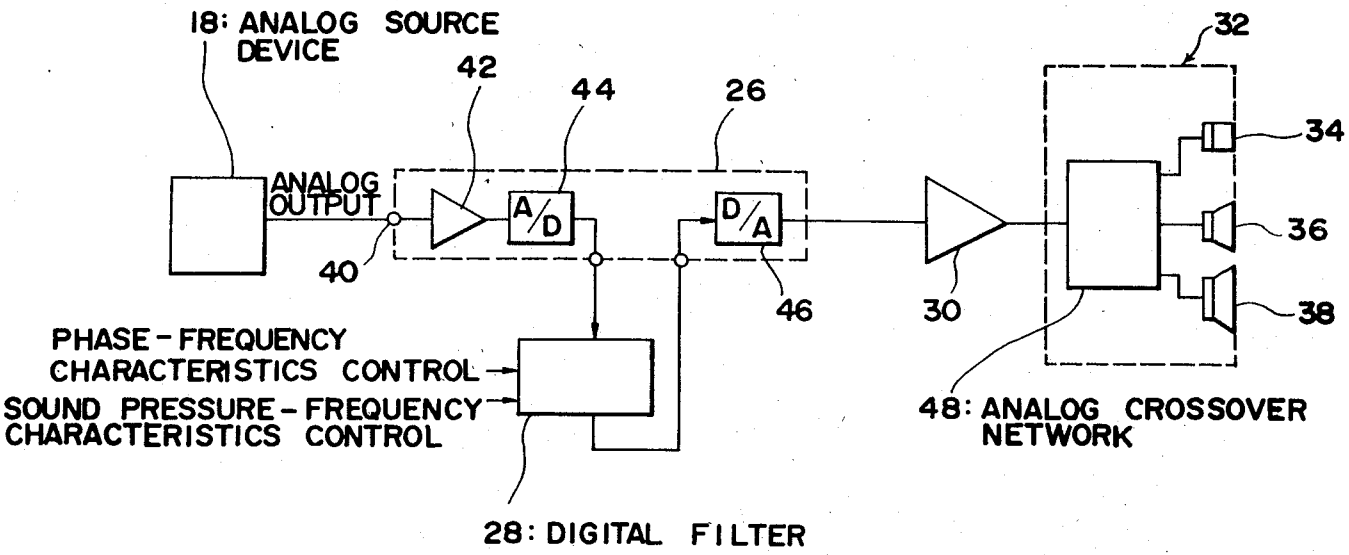
FIG. 4 is a block diagram showing an example of construction in a case where an analog signal source device is used as a source device 18 in the embodiment of FIG. 1.

An example of construction of the loudspeaker device in the case where an analog signal source device is used as the source device 18 in FIG. 1 is shown in FIG. 4.

An analog output signal provided from the analog signal source device 18 is applied to an analog input terminal 40 of the preamplifier 26. The input analog signal is converted to a digital signal by an analog-to-digital converter 44 through an analog preamplifier 42 (a device including a tone control circuit and other circuits) and corrected in phase (and in amplitude also if necessary) by a digital filter 28. The digital filter 28 is so constructed that sound pressure-frequency characteristics and phase-frequency characteristics can be adjusted independently from each other.

The output of the digital filter 28 is converted to an analog signal by a digital-to-analog converter 46 and supplied to a loudspeaker system 32 through a power amplifier 30. The signal applied to the loudspeaker system 32 is divided into three frequency bands of high frequency, middle frequency and low frequency by an analog crossover network 48 and the signals of the three frequency bands are supplied to the respective loudspeakers 34, 36 and 38.

The analog crossover network 48 is composed of analog elements such as a coil (L), a capacitor (C) and a resistor (R) and values of these elements are determined in such a manner that response levels of the respective frequency bands are equalized (i.e., the sound pressure-frequency characteristics are flattened over all of the frequency bands). In the digital filter 28, the phase-frequency characteristics are determined so that phase difference between the respective frequency bands caused by, for example, the crossover network 48 can be corrected.

(3) In the case where a digital signal source device is used

Figure 5:
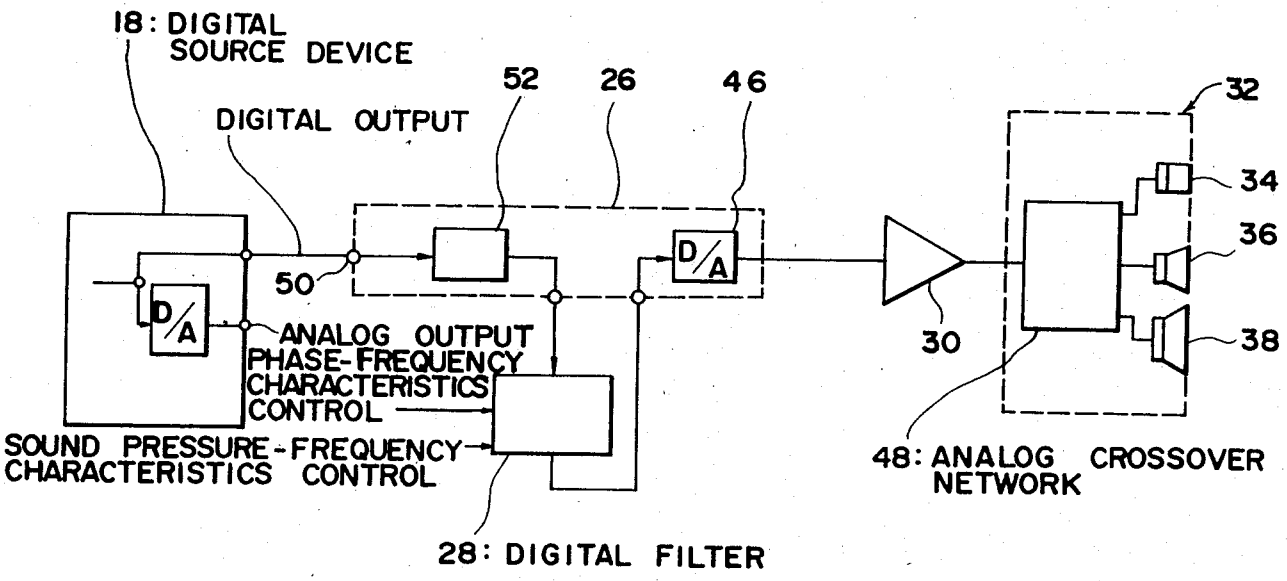
FIG. 5 is a block diagram showing an example of construction in a case where a digital signal source device is used as the source device 18 in the embodiment of FIG. 1.

An example of construction in which a digital signal source device is used as the source device 18 in FIG. 1 is shown in FIG. 5. A digital audio output of the digital source device 18 (e.g., an output from a Compact Disc player before the digital-to-analog conversion and an audio output from a video disc player before the digital-to-analog conversion) is applied to a digital input terminal 50 of the preamplifier 26 and is directly corrected in phase through a digital preamplifier (a device including a tone control circuit and other circuits) 52. The output of the digital filter 28 is converted to an analog signal by a digital- to-analog converter 46 and thereafter is applied to a loudspeaker system 32 through a power amplifier 30. The analog signal is divided in three frequency bands by a crossover network 48 and the signal of the respective frequency bands are supplied to the loudspeakers 34, 36 and 38.

In this example also, the phase-frequency characteristics of the digital filter 28 are determined in such a manner that, for example, phase difference between the frequency bands caused by the crossover network 48 is corrected.

(4) An example of the digital filter 28

Figure 6:
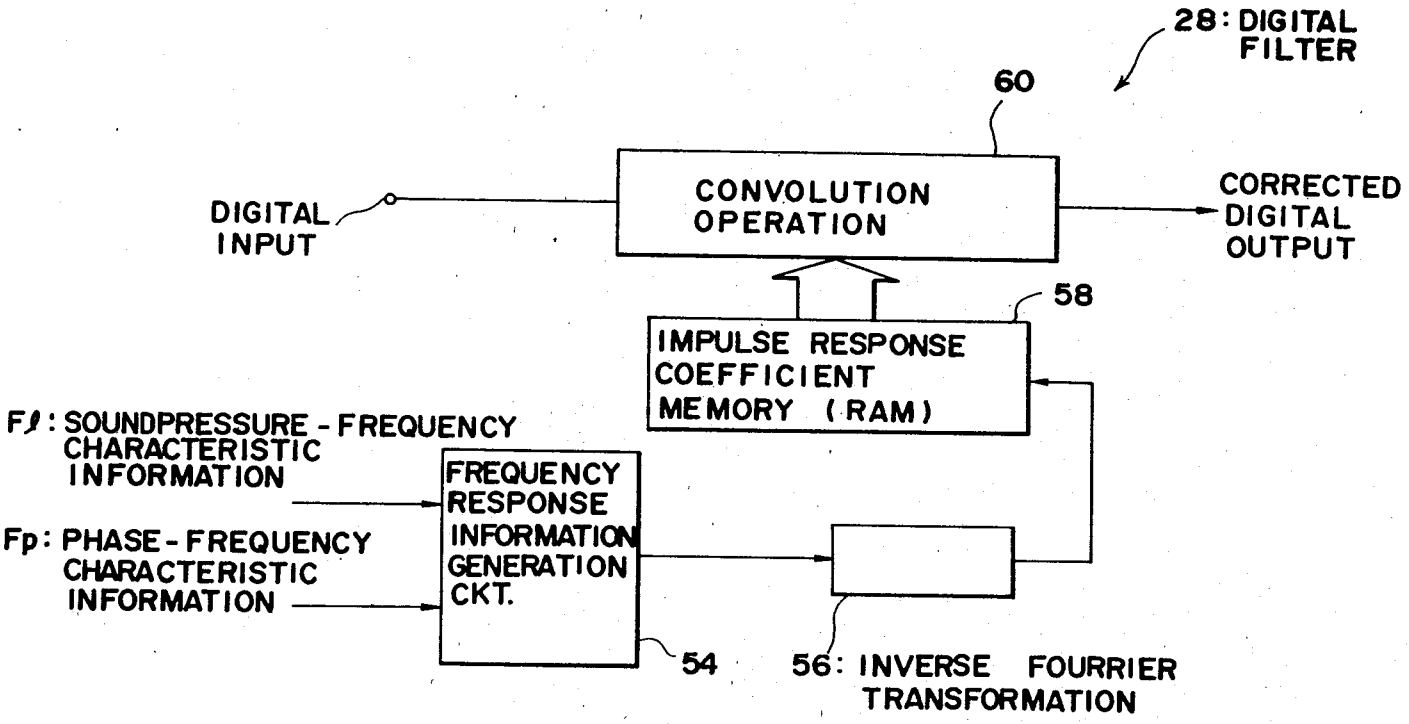
FIG. 6 is a block diagram showing an example of construction of a digital filter 28 used in the embodiment of FIG. 1.

An example of the digital filter 28 is shown in FIG. 6. In this example, the digital filter 28 is constructed of an FIR (non recursive type) digital filter. In the FIR digital filter, desired filter characteristics are imparted to a digital input signal by subjecting the digital input signal to convolution operation (i.e., an operation of delaying a digital input signal, multiplying it with desired coefficients and thereafter summing delayed signals together) by employing characteristics on time axis of the filter (impulse response). The characteristics on time axis of the filter are obtained by subjecting characteristics on frequency axis of the filter to inverse Fourier transformation.

In FIG. 6, a frequency-response information generation circuit 54 produces information of filter characteristics to be established in the form of characteristics on the frequency axis. The filter characteristics can be established in such a manner that sound pressure-frequency characteristics and phase-frequency characteristics are established independently from each other by sound pressure-frequency characteristics information Fl and phase-frequency characteristics information Fp. If the filter characteristics determined by the sound pressure-frequency characteristic information Fl and phase-frequency characteristics information Fp are represented by f(R,I) (R being a real number section and I being an imaginary number section), the filter characteristics f(R, I) in a case where the sound pressure-frequency characteristics information Fl is fixed and the phase-frequency characteristics information Fp only is changed are such that $\sqrt{R^2+I^2}$ is fixed and R/I is changed. In other words, the sound pressure-frequency characteristics remain unchanged whereas the phase-frequency characteristics are changed. In a case where the phase-frequency characteristics information Fp is fixed and the sound pressure-frequency characteristics information Fl only is changed, the filter characteristics are such that R/I is fixed and $\sqrt{R^2+I^2}$ is changed. In other words, the phase-frequency characteristics remain unchanged whereas the sound pressure-frequency characteristics are changed.

The filter characteristics f(R,I) to be established by the frequency-response information generation circuit 54 are determined in the following manner:

If transfer function of a loudspeaker system to be used is represented by Hsp(S), transfer function to be obtained by Hd(S) and transfer function of the digital filter 28 by HF(S), $H_d(S)$: $H_{sp}(S)\ H_F(S)$ $H_F(S)$: $H_d(S)/H_{sp}(S)$ Alternatively stated, the filter characteristics f(R,I) provided by the frequency-response generation circuit 54 are determined by the sound pressure-frequency characteristics information Fl and the phase-frequency characteristics information Fp so that this transfer function $H_F(S)$ can be obtained.

If, for example, in a case where sound pressure-frequency characteristics of a loudspeaker system used are flat and phase-frequency characteristics thereof are not linear, it is desired to make both characteristics flat by correcting the phase-frequency characteristics, the phase-frequency characteristics of the loudspeaker system are corrected by setting the sound pressure-frequency characteristics information Fl to 1 and the phase-frequency characteristics information Fp to a value which will cancel deviation from linear characteristics whereby the sound pressure-frequency characteristics become flat and the phase-frequency characteristics become linear.

If both the sound pressure-frequency characteristics and phase-frequency characteristics of the loudspeaker system require correction, such correction can be made and desired characteristics of the loudspeaker system can be obtained by setting the sound pressure-frequency characteristics information Fl and the phase-frequency characteristics information Fp to values which will cancel deviations from the desired characteristics. Accordingly, even in a case where the sound pressure-frequency characteristics cannot be made completely flat by an analog crossover network of the loudspeaker system, the sound pressure-frequency characteristics can be made flat and the phase-frequency characteristics can be made linear.

In FIG. 6, filter characteristics information on the frequency axis generated by the frequency-response information, generation circuit 54 is subjected to inverse Fourier transformation by an inverse Fourier transformation circuit 56 for obtaining filter characteristics on the time axis, i.e., impulse response. The impulse response information thus obtained is stored in an impulse response coefficient memory (RAM) 58. Since impulse response is provided by combination of delay time and coefficient, the impulse response coefficient memory 58 stores coefficients which correspond to the respective delay times in the addresses corresponding to such delay times.

Figure 7:
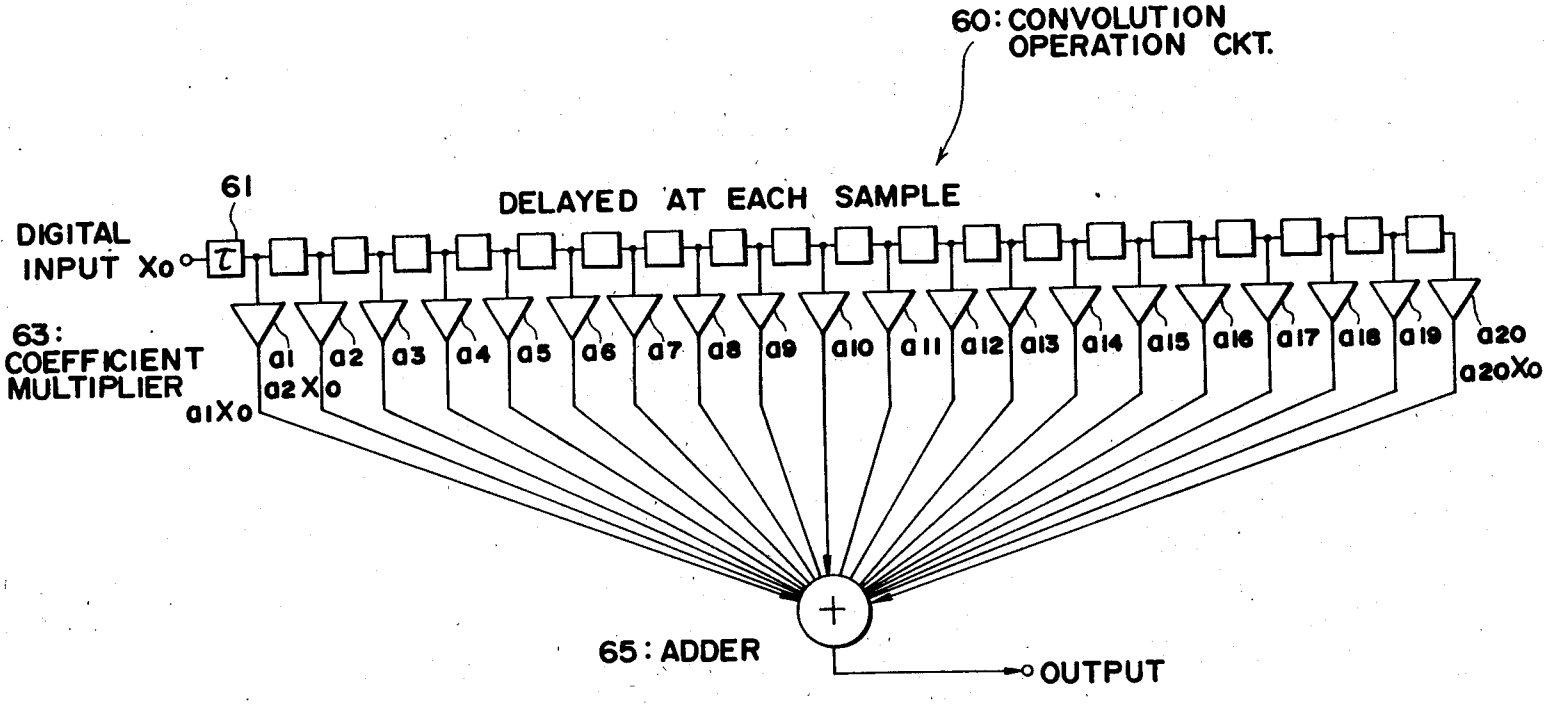
FIG. 7 is a block diagram showing an example of construction of convolution operation means in FIG. 6.

In a convolution operation circuit 60, as shown in FIG. 7, a digital input signal is sequentially delayed at each sample point by a delay circuit 61, respective delay outputs are multiplied by a coefficient multiplier 63 with coefficients a1, a2, . . . for the respective delay times stored in the impulse response coefficient memory 58, results of multiplication are added together by an adder 65 and result of addition is provided from the adder 65. Since this output of the adder 65 is the digital input signal imparted with the filter characteristics established by the frequency-response information generation circuit 54, if the filter characteristics are established by the frequency-response information generation circuit 54 in such a manner that a non-flat state of the sound pressure-frequency characteristics and a non-linear state of the phase-frequency characteristics of the loudspeaker system used are corrected, the sound pressure-frequency characteristics and phase-frequency characteristics of sound provided by the loudspeaker system are made flat and linear with resulting improvement in naturalness in hearing.

If it is not necessary to change the filter characteristics (e.g., the same loudspeaker system is always used), the impulse response coefficient memory 58 may be composed of a ROM which has stored coefficients prepared by separate computation. In this case, the frequency-response information generation circuit 54 and inverse Fourier transformation circuit 56 become unnecessary.

[Embodiment 2]

(1) Outline

Figure 8:
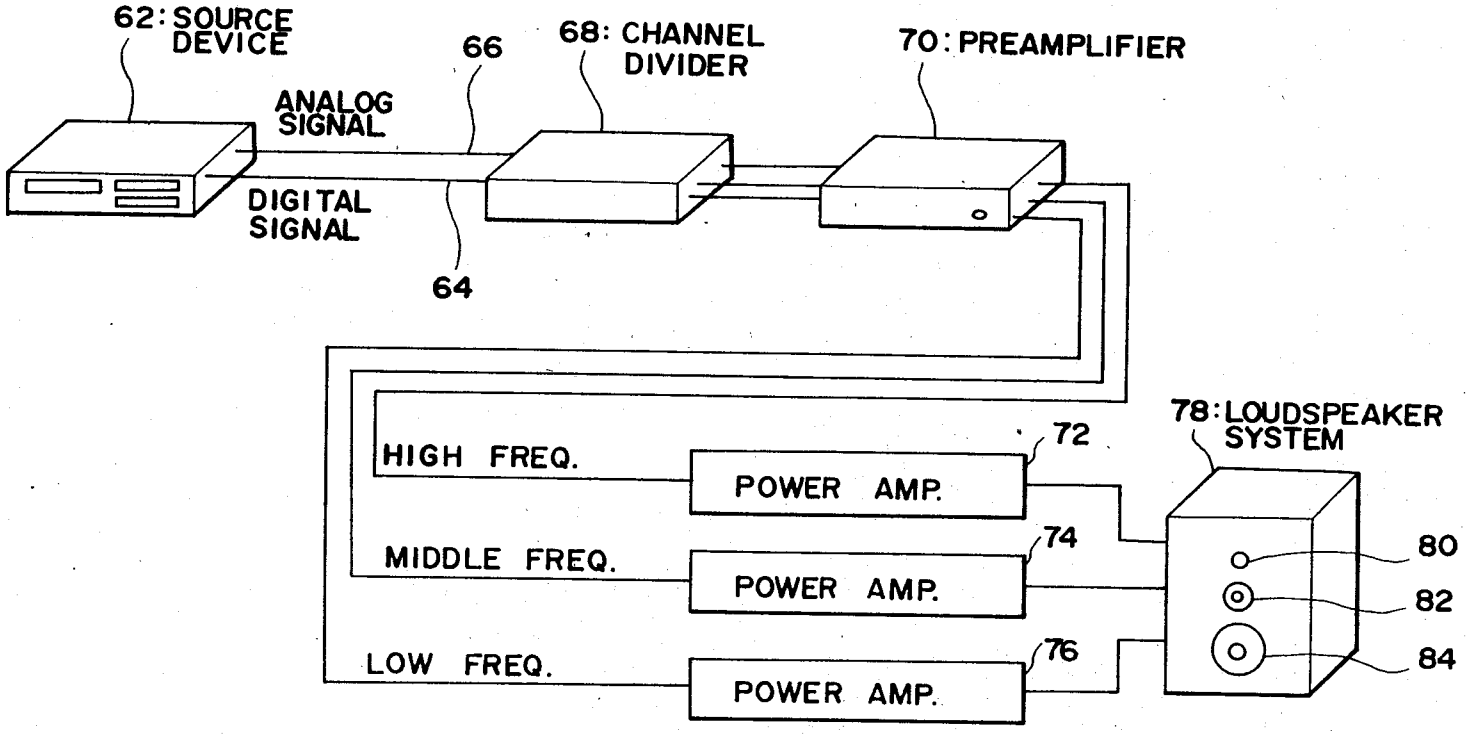
FIG. 8 is a schematic view of a second embodiment of the invention.

Another embodiment of the invention is shown in FIG. 8. In this embodiment, the invention is applied to a multi-amplifier system and a digital filter capable of establishing sound pressure-frequency characteristics and phase-frequency characteristics independently from each other is provided in a channel divider connected to the multi-amplifier system.

The output of a source device 62 is applied to a channel divider 68 through a chord 64 (in case of a digital output) or a chord 66 (in case of an analog output). In the channel divider 68, the digital filter establishes sound pressure-frequency characteristics and phase-frequency characteristics for each of high, middle and low frequency bands and the respective filter outputs are provided after digital-to-analog conversion.

The respective outputs of the channel divider 68 are applied to a preamplifier 70 for tone color control and thereafter are supplied to a tweeter 80, a squawker 82 and a woofer 84 of a loudspeaker system 78 through power amplifiers 72, 74 and 76.

(2) An example of the channel divider 68

Figure 9:
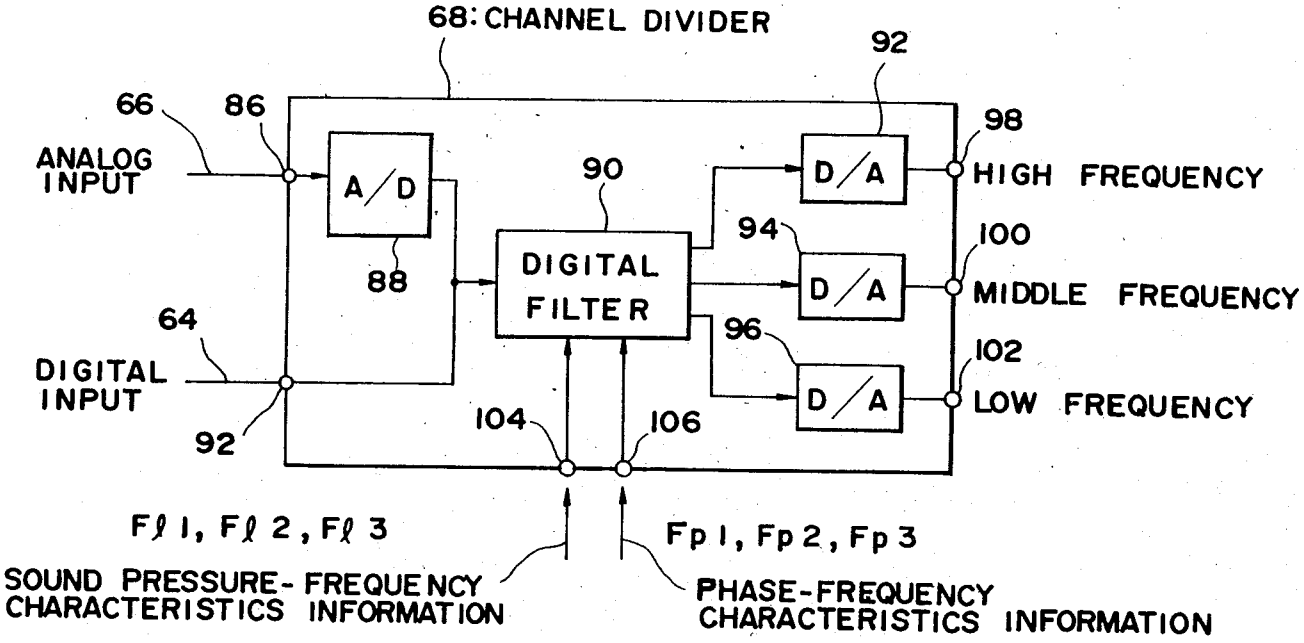
FIG. 9 is a block diagram showing an example of construction of a channel divider 68 in the embodiment of FIG. 8.

An example of construction of the channel divider 68 is shown in FIG. 9.

If the output signal from the source device 62 is an analog signal, the signal is applied from an analog input terminal 86 and is applied to a digital filter 90 through an analog-to-digital converter 88. If the output signal from the source device 62 is a digital signal, the signal is applied from a digital input terminal 92 and is directly applied to the digital filter 90.

The digital filter 90 divides the input signal into three frequency bands of high, middle and low frequency bands in accordance with sound pressure-frequency characteristics information Fl1–Fl3 supplied to a terminal 104. The digital filter 90 also controls phase-frequency characteristics of the respective frequency bands thus divided in accordance with phase-frequency characteristics information Fp1–Fp3 supplied to a terminal 106. The sound pressure-frequency characteristics and the phase-frequency characteristics can be established independently from each other in the respective frequency bands in accordance with the sound pressure-frequency characteristics information Fl1–Fl3 and the phase-frequency characteristics information Fp1–Fp3.

Figure 10:
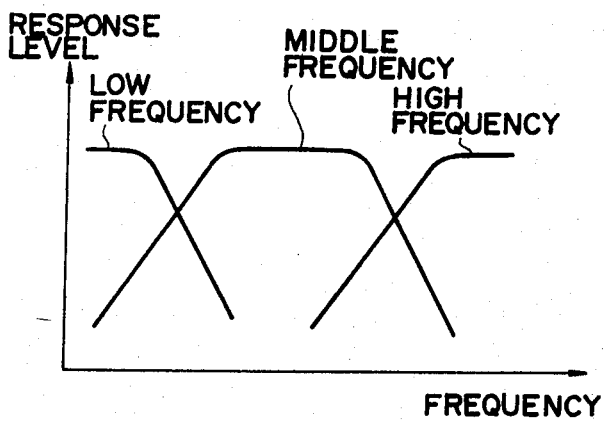
FIG. 10. is a graph showing an example of sound pressure-frequency characteristics in a digital filter 90 in FIG. 9.
Figure 11:
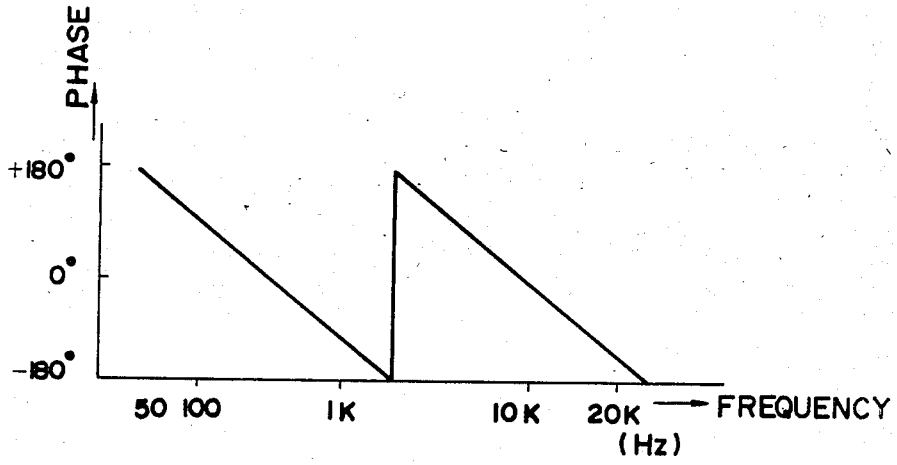
FIG. 11 is a graph showing an example of phase-frequency characteristics in the digital filter 90 in FIG. 9.

By this arrangement, the sound pressure-frequency characteristics can be made flat over all of the three frequency bands as shown in FIG. 10 and the phase-frequency characteristics can be made linear over all of the frequency bands as shown in FIG. 11.

The establishment of the filter characteristics can be made also by utilizing a data cartridge such as a ROM.

Signals for the respective frequency bands provided by the digital filter 90 are converted to analog signals by digital-to-analog converters 92, 94 and 96 and thereafter are outputted from output terminals 98, 100 and 102 and supplied to the tweeter 80, squawker 82 and woofer 84 of the loudspeaker system 78 through the preamplifier 70 and power amplifiers 72, 74 and 76 in FIG. 8. The digital-to-analog converters 92, 94 and 96 may be provided on the side of the preamplifier 70 of FIG. 8.

(3) An example of the digital filter 90

Figure 12:
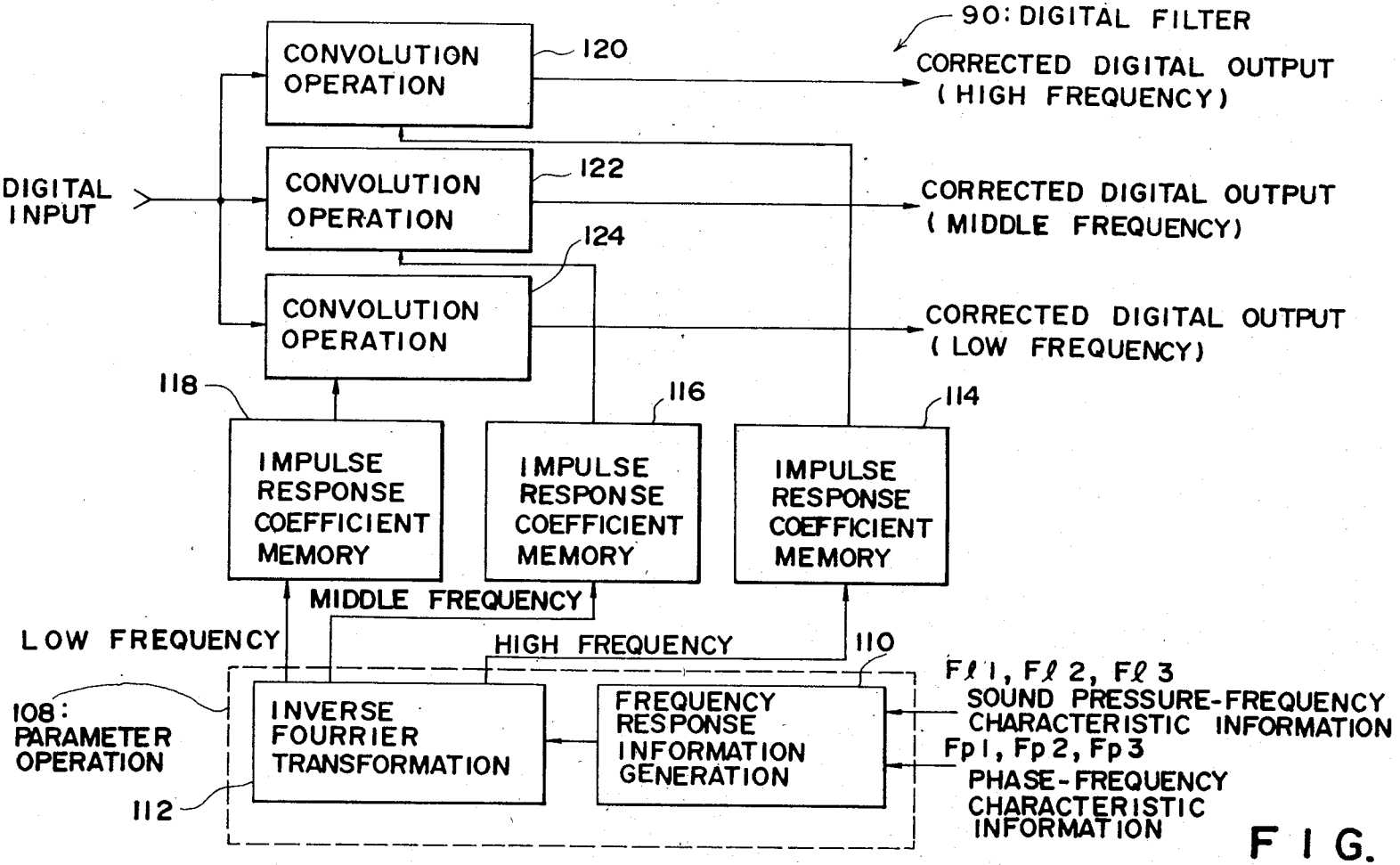
FIG. 12 is a block diagram showing an example of construction of the digital filter 90 in FIG. 9.

An example of construction of the digital filter 90 is shown in FIG. 12. In a parameter operation circuit 108, a frequency-response information generation circuit 110 produces, in the form of characteristics on the frequency axis, information of filter characteristics of respective frequency bands specified by combinations of the sound pressure-frequency characteristics information Fl1 and the phase-frequency characteristics information Fp1, information Fl2 and Fp2, and information Fl3 and Fp3 in accordance with the input information Fl1–Fl3 and Fp1–Fp3. The filter characteristics information of the respective frequency bands are respectively converted, on a time shared basis, to filter characteristics on the time axis (i.e., impulse response) by an inverse Fourier transformation circuit 112.

The impulse response of the high frequency band is stored in an impulse response coefficient memory (RAM) 114. In the memory 114, respective coefficients are stored at addresses corresponding to respective delay times of the impulse response. In a convolution operation circuit 120, a digital input signal is sequentially delayed at each sample point, delayed outputs are multiplied with coefficients corresponding to the respective delay times stored in the impulse response coefficient memory 114 for the high frequency band and results of the multiplication are added together and provided as an output of the high frequency band.

Likewise, the impulse response of the middle frequency band is stored in an impulse response coefficient memory 116 and convolution operation between the impulse response and the digital input signal is performed by a convolution operation circuit 122 for producing an output of the middle frequency band.

The low frequency impulse response is likewise stored in an impulse response coefficient memory 118 and convolution operation between the impulse response and the digital input signal is performed by a convolution operation circuit 124 for producing an output of the low frequency band.

In the above described manner, the digital filter 90 of FIG. 12 adjusts the sound pressure-frequency characteristics and the phase-frequency characteristics with respect to each of the frequency bands in accordance with the sound pressure-frequency characteristics information Fl1–Fl3 and the phase-frequency characteristics information Fp1–Fp3 whereby a multi-amplifier system with excellent sound pressure-frequency and phase-frequency characteristics over the entire frequency bands can be constructed. This enables optimum frequency band division and phase correction which is theoretically feasible but actually is difficult to achieve by an analog filter.

[Embodiment 3]

Figure 13:
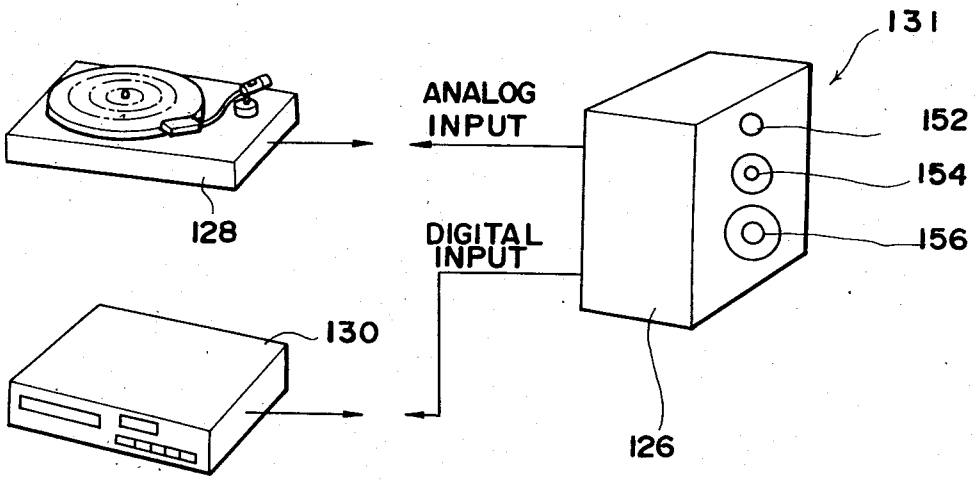
FIG. 13 is a schematic view showing a third embodiment of the invention.

Still another embodiment of the invention is shown in FIG. 13. In this embodiment, an analog signal source device (e.g., a record player) 128 or a digital signal source device (e.g., a digital output of a Compact Disc player) 130 can be directly connected to a loudspeaker system 131 by incorporating essential component parts in an enclosure 126.

Figure 14:
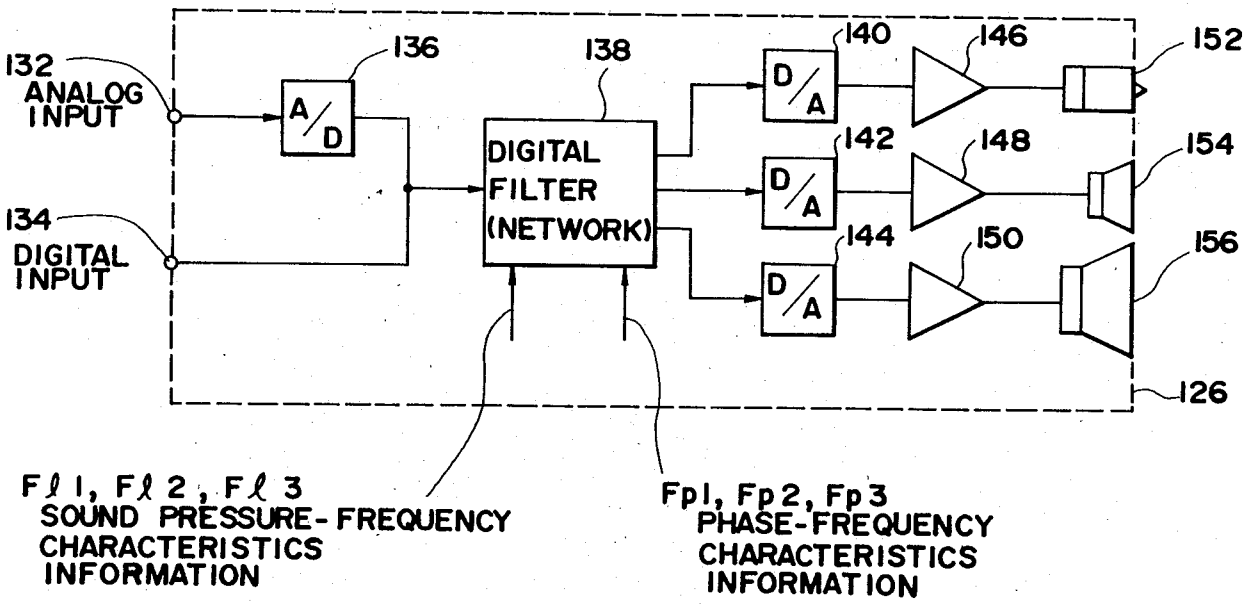
FIG. 14 is a block diagram showing an example of internal construction of an enclosure 126 in the embodiment of FIG. 13.

An example of construction within the enclosure 126 is shown in FIG. 14. The enclosure 126 has an analog input terminal 132 and a digital input terminal 134. An analog input signal applied from the analog input terminal 132 is converted to a digital signal by an analog-to-digital converter 136 and thereafter is applied to a digital filter 138. A digital input signal applied from the digital input terminal 134 is directly applied to the digital filter 138.

The digital filter 138 functions as a crossover network. The digital filter 138 may be constructed, for example, in the same manner as the digital filter 90 of the previously described embodiment 2 (FIG. 9), e.g., the one shown in FIG. 12.

The digital filter 138 establishes sound pressure-frequency characteristics for each of the high, middle and low frequency bands in accordance with the sound pressure-frequency characteristics information Fl1, Fl2 and Fl3 and phase-frequency characteristics for each frequency band in accordance with the phase-frequency characteristics information Fp1, Fp2 and Fp3.

The digital signal applied to the digital filter 138 is divided into high, middle and low frequency bands in accordance with the established sound pressure-frequency characteristics and the signals of these frequency bands are provided with the phase-frequency characteristics in accordance with the established phase-frequency characteristics.

A high frequency band signal provided by the digital filter 138 is converted by a digital-to-analog converter 140 to an analog signal and thereafter is supplied to a tweeter 152 through a power amplifier 146. A middle frequency band signal is converted by a digital-to-analog converter 142 to an analog signal and supplied to a squawker 154 through a power amplifier 148. A low frequency band signal is converted by a digital-to-analog converter 144 to an analog signal and supplied to a woofer 156 through a power amplifier 150.

The establishment of filter characteristics may also be made by a ROM storing filter characteristics information obtained by operation in a separate circuit (e.g., impulse response coefficient).

By incorporating the essential component parts in the enclosure 126 in the above described manner, the analog signal source device 128 and the digital signal source device 130 can be connected directly to the loudspeaker system 131. In this embodiment, the analog crossover network used in the conventional loudspeaker system is obviated.

What is claimed is:

1. A loudspeaker device having a digital filter for adjusting sound pressure and phase characteristics comprising:

input means for obtaining a digital input signal representing a sound to be sounded by a loudspeaker;

phase control means for receiving the digital signal from said input means, said phase control means including a digital filter having means for controlling sound pressure-frequency characteristics and phase-frequency characteristics thereof independently from each other;

loudspeaker drive means for producing a loudspeaker drive signal in accordance with the modified digital signal; and loudspeaker means driven by said loudspeaker drive signal.

2. A loudspeaker device as defined in claim 1 wherein said input means comprises an analog-to-digital converter for converting an analog input signal applied to said input means to a digital signal.

3. A loudspeaker device as defined in claim 2 wherein said loudspeaker drive means comprises a digital-to-analog converter for converting the digital signal provided by said phase control means to an analog signal.

4. A loudspeaker device as defined in claim 3 wherein said digital filter constituting said phase control means has a plurality of taps and is adjusted in its phase characteristics by adjusting coefficients in respective taps thereof.

5. A loudspeaker device as defined in claim 4 wherein said loudspeaker means is of a multi-way speaker system having plural speakers for plural frequency bands and has an analog crossover network.

6. A loudspeaker device as defined in claim 4 wherein said digital filter produces digital signals for plural frequency bands and said loudspeaker drive means comprises digital-to-analog converters for converting the digital signals for the plural frequency bands to analog signals, power amplifiers for power-amplifying the analog signals provided by said digital-to-analog converters, and said loudspeaker means comprises loudspeaker units for the respective frequency bands to which outputs of the power amplifiers of the loudspeaker drive means are applied.

7. A loudspeaker device as defined in claim 4 wherein said input means, said phase correction means, said loudspeaker drive means and said loudspeaker means are integrally incorporated in a loudspeaker enclosure.

* * * * *